United States Patent [19]

Urschel et al.

[11] Patent Number: 4,813,317

[45] Date of Patent: Mar. 21, 1989

[54] ROTARY SLICING MACHINE

[75] Inventors: Joe R. Urschel, Valparaiso; Mark J. Barlog, Wheatfield; Eugene H. Cole; Gerald W. Urschel, both of Valparaiso, all of Ind.

[73] Assignee: Urschel Laboratories, Inc., Valparaiso, Ind.

[21] Appl. No.: 41,487

[22] Filed: Apr. 23, 1987

[51] Int. Cl.[4] ..... B26D 1/36; B26D 3/28

[52] U.S. Cl. ..... 83/356.3; 83/409.2; 83/663

[58] Field of Search ..... 83/356.1, 356.3, 357, 83/155, 409, 409.2, 437, 417, 422, 591-596, 663, 674

[56] References Cited

U.S. PATENT DOCUMENTS

| | | | |
|---|---|---|---|
| 2,664,130 | 12/1953 | Kubon | 83/858 |
| 2,861,610 | 11/1958 | Ramsay | 83/596 |
| 3,913,643 | 10/1975 | Lambert | 83/356.3 |
| 4,312,252 | 1/1982 | Duddridge | 83/155 |
| 4,584,919 | 4/1986 | Bittner | 83/663 |
| 4,648,296 | 3/1987 | Wisdom et al. | 83/409.2 |

*Primary Examiner*—Frank T. Yost
*Assistant Examiner*—Hien H. Phan
*Attorney, Agent, or Firm*—Bacon & Thomas

[57] ABSTRACT

A rotary slicing machine including a cylindrical-shaped cutter assembly having at least one knife element and mounted for rotation about a horizontal axis is provided with an elongate feed chute within which the individual products to be sliced are supported in a linear array and consecutively fed under gravity into the path of the rotating knife element. The feed chute is provided with an elongate slot for permitting the manual positioning of the products within the chute.

7 Claims, 3 Drawing Sheets

51

31
53
3
41
R
41
57
47
43
F
41
45
39
25
21
23
47
49
49
49
5
55

ROTARY SLICING MACHINE

BACKGROUND OF THE INVENTION

1. Field of the Invention

The present invention generally involves the field of technology pertaining to apparatus for slicing products. More specifically, the invention relates to an improved rotary slicer that is particularly useful for slicing a variety of products, particularly agricultural products having a substantially round configuration, such as apples, onions, tomatoes and the like.

2. Description of the Prior Art

There are many forms and types of known machines for slicing meat and agricultural products. Such machines generally include one or more knife elements, means for adjusting the slice thickness, and means for feeding the product to the knife element.

A conventional slicing machine of the type utilized in meat markets includes a circular-shaped knife which is disposed for rotation relative to a movable fixture which functions as a gauge. The product is clamped to the fixture which has been preset for a desired slice thickness. The fixture and clamped product are then manually moved across the rotating knife to produce slices of the product. Control of the slice thickness is realized by indexing the fixture in a direction at a right angle to the slicing movement. This type of machine is capable of accurate control over slice thickness but is not capable of a high production rate.

Another type of known slicing machine utilizes a reciprocating gauge plate and knife assembly against which a supply of product is gravity or force fed to the knife. The distance between the plane of the gauge plate and the plane of the knife element determines the slice thickness. A supply of the product may be fed to the knife through a vertical feed tube, with the gauge plate and knife assembly reciprocating in a horizontal direction. Due to the nature of the knife movement, the product is caused to be shifted back and forth within the feed tube, thereby resulting in slices of nonuniform thickness and configuration, particularly at high production rates. A slicing machine of this type is capable of producing relatively uniform slices, but only at relatively low operational speeds and with solid products which do not have tough outer skins, such as potatoes.

A further type of slicing machine is known wherein, instead of a reciprocating gauge plate and knife assembly, the gauge plate is of a circular configuration and rotatable so that the vertically descending product is caused to be brought into the path of the rotating knife. In order for this machine to operate properly, it is desired that the product being sliced move down vertically in the feed tube at a uniform rate, a function which is realized by configuring the surface of the gauge plate so that the plate forming a circle near its center must gradually drop down an amount equal to the thickness of the slice as the circle approaches the knife edge. This configuration also applies for the surface of the plate forming a circle near its perimeter, but the drop must be more gradual because of the greater distance. As apparent, this type of surface is extremely difficult to form. Moreover, the knife cannot pass straight through the product being sliced since it turns during the slicing process, thereby imparting a twist to the product in the feed tube. As in the case of the reciprocating gauge plate and knife assembly, this type of machine will also produce a relatively uniform slice thickness, but only at slow operational speeds and on certain kinds of products. A modified form of this latter type of machine provides a stationary circular gauge plate and knife assembly wherein one or more feed tubes are caused to rotate about a common axis to impact the product against the knife. However, results realized in slicing a product by this modified form are similar to those of the rotating gauge plate.

Yet another type of slicing machine utilizes a cylindrical-shaped stationary cutter assembly within which a plurality of spaced parallel knife and gauge plate assemblies are circumferentially supported for slicing food products that are centrifugally fed to the knives, or gravity fed to the knives when the cutter assembly is disposed for rotation about a horizontal axis. In the latter form of this machine, it is known to position a square feed chute within the cutter assembly whereby the longitudinal axis of the chute is perpendicular to the horizontal axis of rotation of the cutter assembly. Product being fed into the chute is supplied from a hopper disposed exteriorly of the cutter assembly. An example of this type of slicing machine is disclosed by the Urschel U.S. Pat. No. 2,187,957.

SUMMARY OF THE INVENTION

It is an object of the invention to provide an improved machine for slicing any cutable article or product at a high rate of speed while producing slices thereof having a uniform thickness.

It is another object of the invention to provide an improved machine for slicing a variety of agricultural products of different configurations at high production speeds to produce slices having controlled and uniform thickness.

It is a further object of the invention to provide an improved rotary slicing machine wherein the product being sliced is fed to at least one knife element in a controlled and stable manner with proper orientation of the product relative to the knife element.

It is still another object of the invention to provide an improved machine for slicing agricultural products having different external and internal characteristics, such as ripe tomatoes, green peppers and the like.

These and other objects of the invention are realized by providing a slicing machine that includes a cylindrical-shaped rotary cutter assembly having an open side and supported for rotation about a horizontal axis. The cutter assembly is provided with at least one elongate knife element disposed parallel to the axis of rotation, and also parallel to and spaced from remaining knife elements when plural knife elements are utilized. Each knife element is disposed adjacent a gauge plate for presetting the desired slice thickness. The individual products to be sliced are stored in a linear array within an elongate feed chute which is supported with its outlet end disposed within the open side and positioned rearwardly of the bottom dead center point of the cutter assembly. The longitudinal axis of the feed chute is also spaced rearwardly from the cutter assembly axis of rotation whereby a plane encompassing the longitudinal axis of the feed chute intersects a plane encompassing the cutter assembly axis of rotation at an angle of less than 90°. The chute is provided with an elongate slot to permit orienting each product in the desired position for slicing. The product slices are preferably collected below the cutter assembly on a driven conveyor which transfers the slices to a subsequent processing station.

The speed of the conveyor may be controlled relative to the rotational speed of the cutter assembly in order to collect the slices on the conveyor in a stacked, overlapping or spaced manner.

Other objects advantages and features of the invention shall become apparent from the following detailed description of a preferred embodiment of the invention, when taken in conjunction with the drawings wherein like reference characters refer to corresponding parts in the several views.

DETAILED DESCRIPTION OF THE INVENTION

Figure 1:
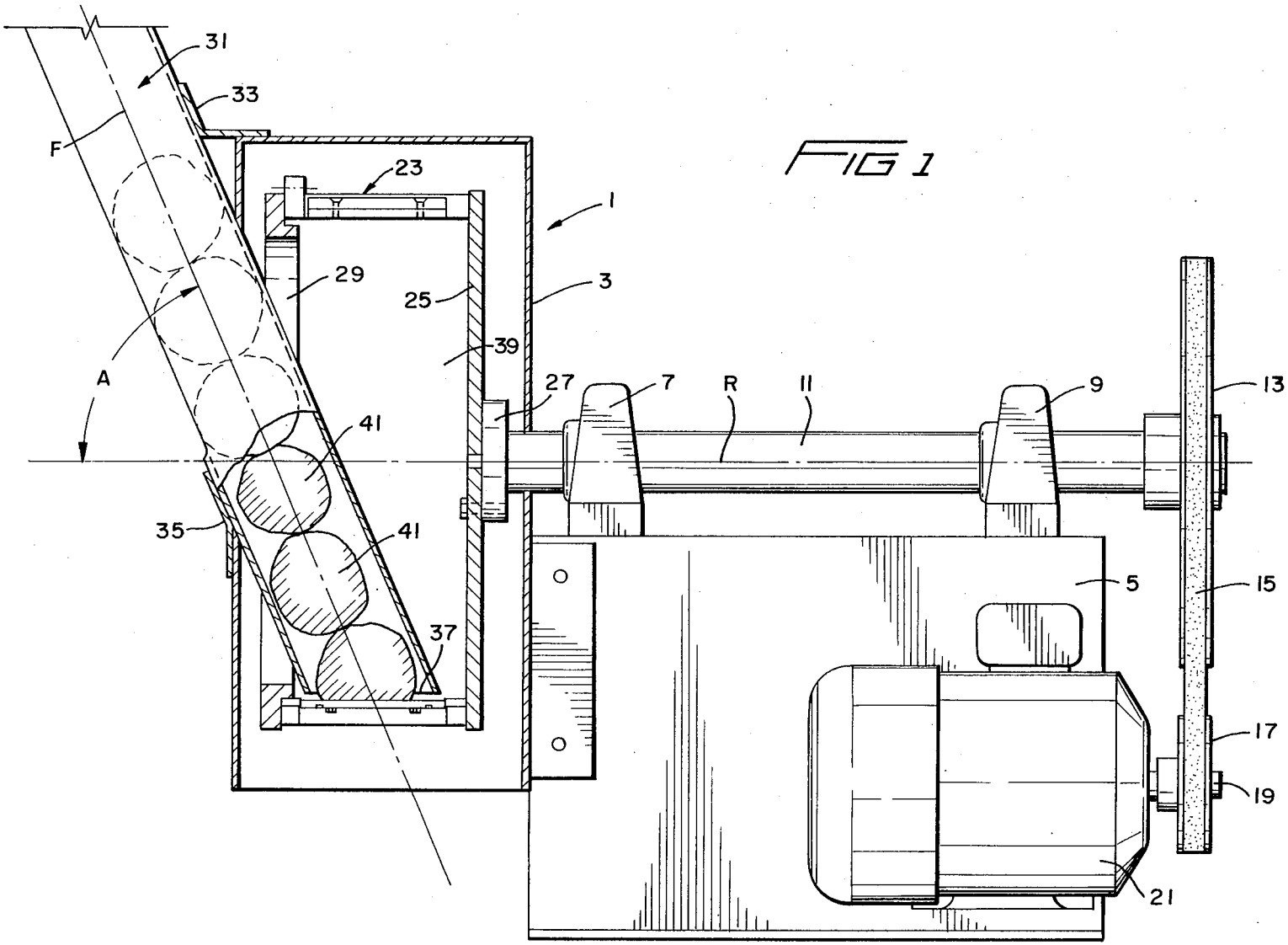
FIG. 1 is a side elevational view, partly in section, showing a rotary slicing machine according to a preferred embodiment of the invention.

A rotary slicing machine 1 according to a preferred embodiment of the invention shall now be described with initial reference to FIG. 1. As shown therein, machine 1 includes a housing 3 secured to a bearing standard 5. A pair of bearings 7 and 9 are mounted on standard 5 and through which a drive shaft 11 is journaled for rotation. One end of shaft 11 is provided with a pulley 13 around which an endless flexible drive belt 15 is engaged. Belt 15 also engages around a second pulley 17 supported on an output shaft 19 of an electric motor 21. Operation of motor 21 therefore serves to rotate shaft 11 in a manner which is well known in the art. It is preferred that motor 21 be secured to bearing standard 5 so as to form an integral unit therewith.

The other end of drive shaft 11 extends within housing 3 for supporting a cylindrical-shaped rotary cutter assembly 23. Shaft 11 is preferably detachably secured to a circular-shaped back plate 25 of cutter assembly 23 by means of an appropriate drive coupling 27. Cutter assembly 23 is provided with a circular-shaped opening 29 opposite plate 25. Rotation of shaft 11 shall therefore cause cutter assembly 23 to also correspondingly rotate within housing 3.

As also depicted in FIG. 1, an elongate hollow feed chute is rigidly secured to housing 3 by a pair of flanges 33 and 35, or other appropriate attachment means. Chute 31 extends through housing 3 and opening 29 of cutter assembly 23 and includes an output opening 37 which is disposed adjacent an internal circumferential wall 39 of cutter assembly 23. As apparent from FIG. 1, a longitudinal axis of rotation R of drive shaft 11 extends centrally through cutter assembly 23. A longitudinal axis F of feed chute 31 intersects wall 39 of cutter assembly 23 at substantially midway between the opposed ends of wall 39. As further seen in FIG. 1, axis R is disposed within a plane which intersects a plane containing axis F at an angle A of less than 90°. A plurality of products 41 stacked within chute 31 in a linear array are caused to consecutively be fed through output opening 37 of chute 31 and engage wall 39 of cutter assembly 23.

Figure 2:
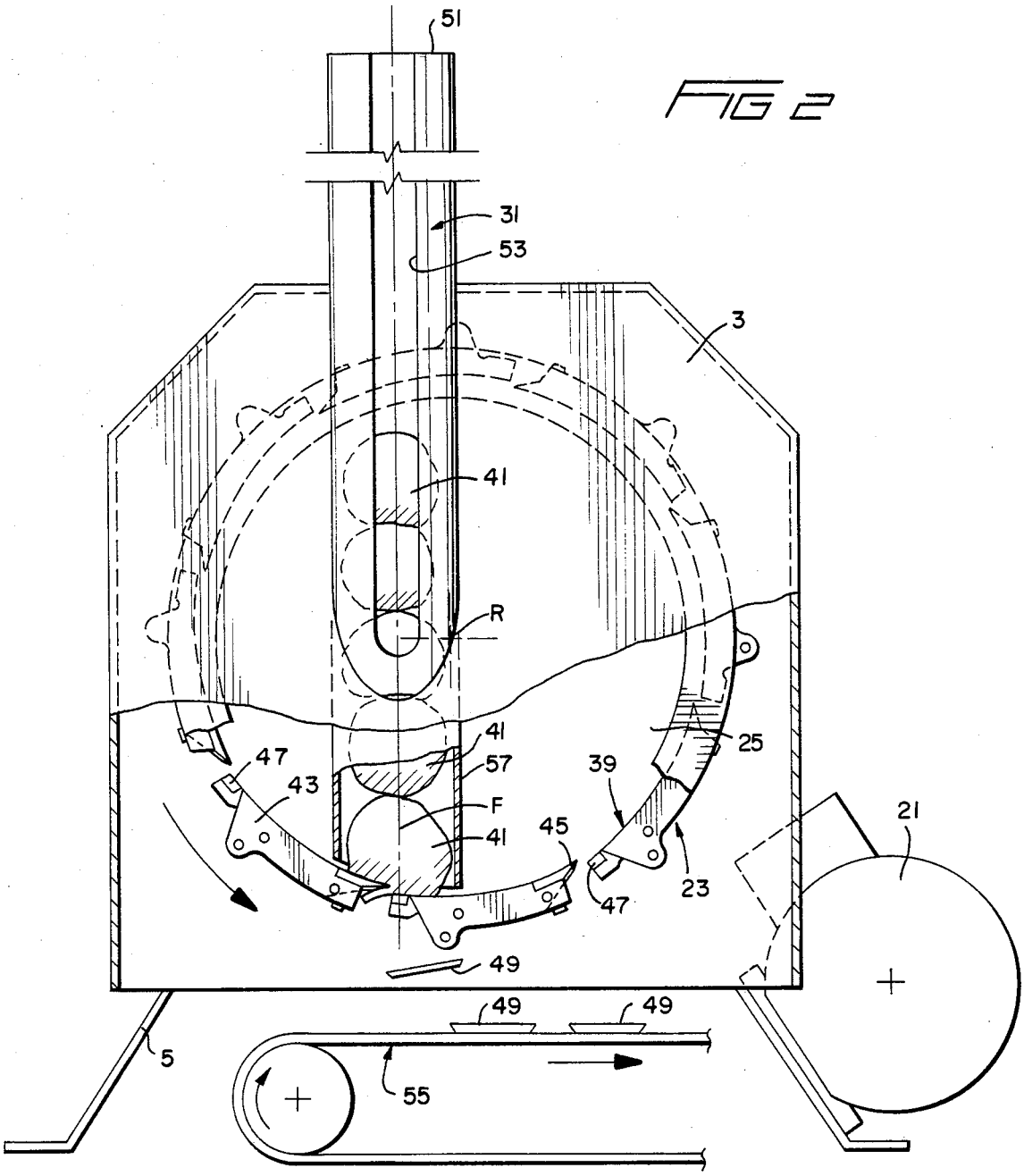
FIG. 2 is an end view, partly in section, of the machine shown in FIG. 1 and including a conveyor disposed beneath the cutter assembly for collecting and removing the sliced product.

With reference to FIG. 2, wall 39 of cutter assembly 23 is defined by a plurality of arcuate cast segments 43, wherein each segment 43 is provided with a knife element 45 at its leading end and a gauge plate 47 at its trailing end with respect to the direction of rotation of cutter assembly 23 as indicated by arrow B. Knife elements 45 extend axially of cutter assembly 23 and are disposed parallel to each other and to axis of rotation R. As products 41 are fed against wall 39, they are caused to be brought into the path of knife elements 45 during rotation of cutter assembly 23, whereby each knife element 45 is caused to cut through product 41 and remove a slice 49 therefrom. The thickness of slice 49 is predetermined by adjusting the position of gauge plate 47 relative to the cutting edge of knife element 45. Though plural knife elements are shown for cutter assembly 23, under certain circumstances it may be desirable to utilize a lesser number of knife elements 45 or even only a single knife element 45.

Cutter assembly 23 is supported for rotation about axis R which is disposed horizontally. Products 41 supplied to feed chute 31 through an inlet opening 51 are preferably fed to knives 45 under the force of gravity. In this way, the overall length of chute 31 can be varied to establish the desired degree of feed force as a function of the number of products 41 maintained in chute 31. However, it is also possible to force feed products 41 through chute 31 by any appropriate feed mechanism well known in the art. Though products 41 may be individually and manually loaded through opening 51, it is also possible to attach the output of a large supply hopper (not shown) to inlet opening 51 for a more sustained and automatic supplying of products 41 to chute 31. In order to permit proper positioning or orientation of products 41 contained within chute 31, a longitudinal slot 53 is provided along the exterior wall of chute 31 so that products 41 may be manually manipulated by the fingers of an operator or engaged by an appropriate tool. This is of particular importance when certain agricultural products, such as cored apples, are being sliced since the final appearance of the slice requires that the product be of a specific orientation when engaged by knife element 45.

Housing 3 is provided with an open bottom through which product slices 49 are caused to fall for collection. As seen in FIG. 2 in partial section, a powered conveyor, generally indicated at 55, is provided for collecting and transporting slices 49 to a subsequent processing station. Conveyor 55 may be of any type well known in the art and deemed suitable for the practice of the invention as described herein. It is desirable that an appropriate control means (not shown) be provided for coordinating the linear speed of conveyor 55 to the rotational speed of cutter assembly 23 so that slices 49 may be collected on conveyor 55 in any one of several ways. For example, the speed of conveyor 55 may be such as to permit slices 49 to collect in a continuous overlapping manner. A faster speed shall permit slices 49 to collect in a flat spaced manner. It is also possible by incrementally indexing the movement of conveyor 55 to collect spaced stacks of slices 49. The control means for coordinating the operation of cutter assembly 23 relative to conveyor 55 is also well known in the art and may be of any type deemed suitable for the practice of the invention.

Figure 3:
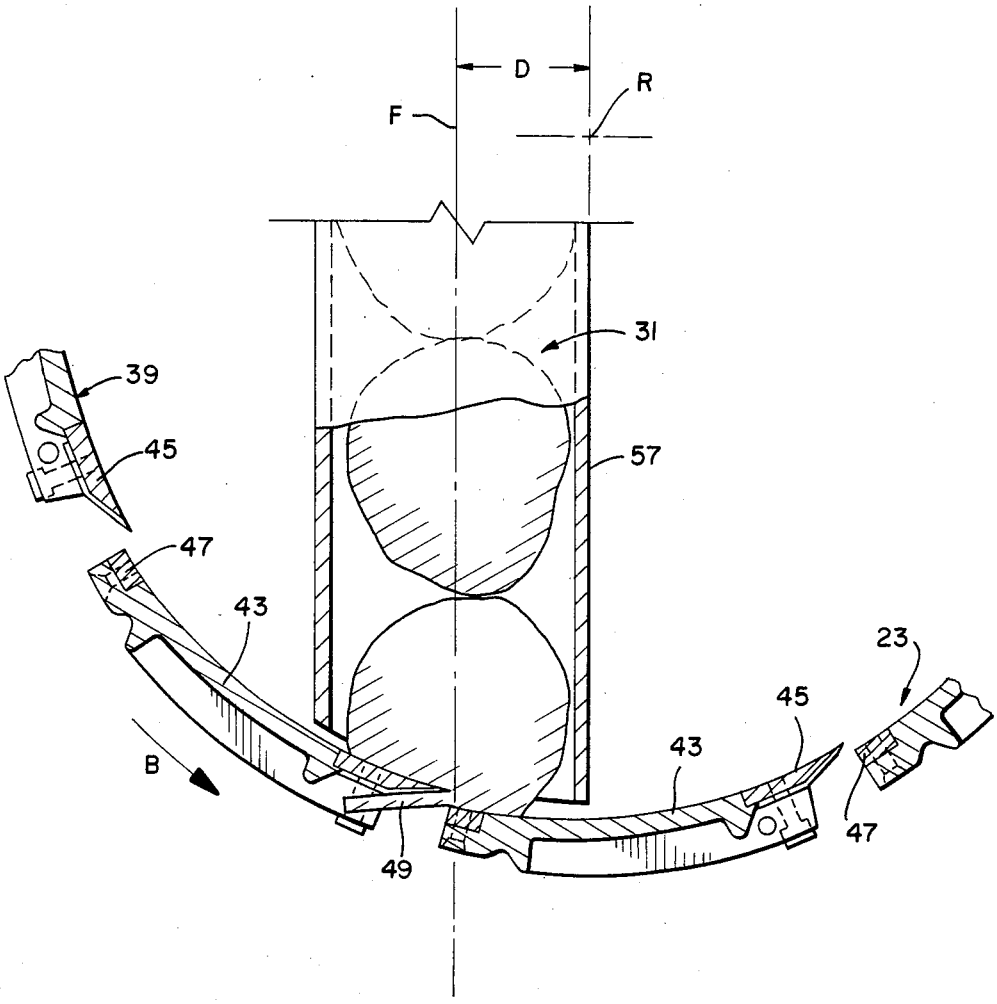
FIG. 3 is a fragmentary view, partly in section, showing the position of the outlet end of the feed chute relative to the knife elements of the cutter assembly.

An important aspect of the invention shall now be described with reference to both FIGS. 2 and 3. As depicted therein, longitudinal axis F of feed chute 31 does not intersect axis of rotation R of cutter assembly 23. Instead, axis F is spaced rearwardly, with respect to the direction of rotation as indicated by arrow B, from axis of rotation R by a distance D, as particularly shown in FIG. 3. Thus, the intersection of axis F and internal wall 39 of cutter assembly 23 occurs at a point rearwardly of the bottom dead center point of cutter assembly 23. Moreover, a forwardmost longitudinal side wall portion 57 of chute 31 preferably extends substantially between and intersects both axis of rotation R and the bottom dead center point of cutter assembly 23. This preferred positioning of side wall portion 57 shall apply notwithstanding the transverse cross-sectional configuration or size of chute 31.

By virtue of the disposition of chute 31 relative to cutter assembly 23 as described herein, each product 41 is caused to always be maintained against the inner surface of side wall portion 57 during the entire slicing operation. In this way, product 41 is prevented from bouncing back and forth within chute 31 during the slicing operation, an undesirable condition usually experienced in conventional slicing machines. As a result, products 41 may be consecutively fed into the path of knife elements 45 which engage each product 41 at an optimum angular position for the production of uniform slices at high production speeds.

The transverse cross-sectional configuration of chute 31 may be of any geometric shape deemed suitable for the type and shape of the product being sliced. Generally, the slicing of common vegetable and fruit products, such as apples, tomatoes, potatoes and green peppers, indicate that a circular configuration is optimum for these substantially round products.

The invention provides an improved machine for slicing a variety of articles and products, particularly agricultural products, in a manner which cannot be duplicated by conventional slicing machines. The angular disposition of feed chute 31 with respect to cutter assembly 23 and positioning of output opening 37 relative to knife elements 45 afford a precise and controlled feeding of products 41 under the force of gravity. The disposition of side wall portion 57 of chute 31 relative to axis of rotation R and the bottom dead center point of cutter assembly 23 maintains each product 41 in an optimum stationary position for slicing at high production speeds. For example, when a substantially round product having a tough outer skin and soft internal structure, such as ripe tomatoes or green peppers, are being sliced, the gravity feed force realized by the configuration of chute 31 maintains each article in position at output opening 37 of chute 31 so that uniform slices thereof may be produced at very high production speeds, whereby the natural inertia of the product shall further assist in securing it in position for slicing.

The invention also produces slices that are both uniform in thickness throughout a slice and uniform in thickness between different slices. This is an important consideration in the process of certain food items. For example, products in which sugar or seasoning must migrate into the interor of the slices during processing must be uniform since the length of processing time shall be undesirably increased if some of the slices are substantially thicker than other slices. Also, products which must be fried or cooled by other means, such as potatoes sliced for potato chips, must be uniform or the thicker slices will become undercooked while the thinner slices will become overcooked or burned. Moreover, thicker fried potato pieces may also retain too much moisture which will produce molding in the container purchased by the consumer. Uniform slices are also important in products that are sliced for dehydration since drying time must be extended in order to insure drying of the thickest slices. The marketing of sliced food products is also an important consideration since the consumer may become critical of such a product when the slices are not uniform in thickness, and especially when the slices have full thickness on one side and taper off to minimum thickness on the other side. These problems are prevalent with sliced products processed by conventional slicing machines and are fully overcome by the improved slicing machine of the present invention.

It is to be understood that the form of the invention herein shown and described is to be taken as merely a preferred embodiment of the same, and that various changes in shape, material, size and arrangement of parts may be resorted to without departing from the spirit of the invention or scope of the subjoined claims.

We claim:

1. An improved rotary slicing machine comprising:

(a) a cylindrical-shaped cutter assembly mounted for rotation about a horizontally disposed central axis of rotation;

(b) the cutter assembly including a circular-shaped front opening and a circumferential wall defined in part by at least one axially extending knife element;

(c) means for rotating the cutter assembly about the central axis of rotation;

(d) a stationary hollow elongate feed chute disposed through the front opening and including an inlet opening and an outlet opening for containing and consecutively feeding a supply of products to the knife element; and (e) the longitudinal axis of the feed chute intersecting the circumferential wall of the cutter assembly approximately midway between the opposite ends of the wall and spaced rearwardly of the axis of rotation with respect to the direction of cutter assembly rotation to dispose the outlet opening of the feed chute adjacent the lower circumferential wall portion of the cutter assembly so that each product is caused to engage the lower circumferential wall portion of the cutter assembly rearwardly of the bottom dead center point thereof for slicing by the knife element during rotation of the cutter assembly.

2. The slicing machine of claim 1 wherein the feed chute includes a longitudinal forwardmost side wall portion extending between the axis of rotation and bottom dead center point of the cutter assembly for maintaining the product in a stable position during the slicing thereof by the knife element.

3. The slicing machine of claim 1 wherein the feed chute includes an elongate slot for permitting access to the products contained therein for positioning same.

4. The slicing machine of claim 1 wherein the feed chute has a substantially circular transverse cross-sectional configuration.

5. The slicing machine of claim 1 wherein a plane encompassing the central axis of rotation and a plane encompassing the longitudinal axis of the feed chute intersect each other at an angle of less than 90°.

6. The slicing machine of claim 1 further including a horizontal conveyor for receiving the slices generated by the knife and conveying same to a subsequent processing point.

7. The slicing machine of claim 6 wherein the conveyor includes control means for regulating the speed of the conveyor in synchronization with the rotational speed of the cutter assembly.

* * * * *